United States Patent [19]

Sarantitis

[11] Patent Number: 4,502,628

[45] Date of Patent: Mar. 5, 1985

[54] CART TRACK

[75] Inventor: Anthony Sarantitis, Pacifica, Calif.

[73] Assignee: Palcon Corporation, San Francisco, Calif.

[21] Appl. No.: 458,385

[22] Filed: Jan. 17, 1983

[51] Int. Cl.[3] ..... E01B 5/02

[52] U.S. Cl. ..... 238/122; 16/102; 238/10 R

[58] Field of Search ..... 238/10 R, 10 F, 13, 238/10 C, 126, 127, 122, 136, 148; 186/62, 63, 64, 65, 34; 16/102, 87.4, 95; 105/170, 177; 104/1 R, 1 A, 99; 211/162

[56] References Cited

U.S. PATENT DOCUMENTS

| | | | |
|---|---|---|---|
| 1,379,958 | 5/1921 | Blumenthal | 238/10 R |
| 2,743,827 | 5/1956 | Winokur et al. | 186/62 X |
| 4,286,752 | 9/1981 | Cheng | 238/10 F |

FOREIGN PATENT DOCUMENTS

| | | | |
|---|---|---|---|
| 1410652 | 10/1975 | United Kingdom | 314/105 |

*Primary Examiner*—Robert B. Reeves
*Assistant Examiner*—Glenn B. Foster
*Attorney, Agent, or Firm*—Townsend and Townsend

[57] ABSTRACT

A cart track assembly for use with a cart having steerable castor wheels includes a pair of parallel, spaced apart tracks mounted to a support surface. Each track includes a number of elongate main track segments and widened transition track segments coupling the main track segments. The main segments have parallel, upright sides defining a relatively narrow pathway between the sides. The widened segments preferably include sides which flare outwardly to define a widened transition area. The transition area is large enough to allow the castor wheels to pivot 180° about their vertical pivot axis after the cart has reversed direction. This allows the castor wheels to roll smoothly along the track after the direction of the movement of the cart has been reversed.

3 Claims, 5 Drawing Figures

CART TRACK

BACKGROUND OF THE INVENTION

Many types of carriages or carts are used to move goods around a work area. To control the movement of the carts, steerable castor wheels are usually used for at least two of the wheels. Castor wheels are mounted to the frame of the cart or carriage to allow them to pivot about a vertical axis. The pivot axis is offset from the horizontal rotational axis of the wheel. This arrangement allows the castor wheel to always be aligned with the direction of movement of the cart.

In some circumstances it is desired to guide carts along tracks. These tracks are usually U-shaped channel members having two spaced-apart sides which guide the wheels. However, if the direction of movement of the cart is reversed while the wheels are within the track, the castor wheels try to pivot about their pivot axes in response to the reversal of direction. The sides of the tracks are usually spaced too closely to allow the wheels to pivot 180°. This causes wheels to drag along the upright sides of the track after such reversal of direction to impede the cart's movement.

SUMMARY OF THE INVENTION

The present invention is directed to a cart track assembly including a pair of parallel, spaced apart tracks mounted to a support surface. Each track includes a number of elongate main track segments and widened transition track segments between the main track segments. The main segments have parallel, upright sides defining a relatively narrow pathway between the sides. The widened segments preferably include sides which flare outwardly to define a widened transition area between the outwardly bowed sides. The transition area is large enough to allow the castor wheels to pivot 180° after the cart has changed direction of travel. This allows the steerable castor wheels to roll smoothly along the track after the direction of the movement of the cart has been reversed.

The primary feature of the invention is the provision of widened transition track segments defining transition areas which allow the castor wheels to pivot 180° thus eliminating dragging along the track sides. This allows the cart to be moved more smoothly and with much less effort.

Another feature of the invention is the provision of the widened segments at staggered positions so not more than one wheel is in a transition area at the same time. When a cart has four wheels, three of the wheels are therefore within main track segments so that the cart continues along its proper course guided by the relatively narrow main track segments.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
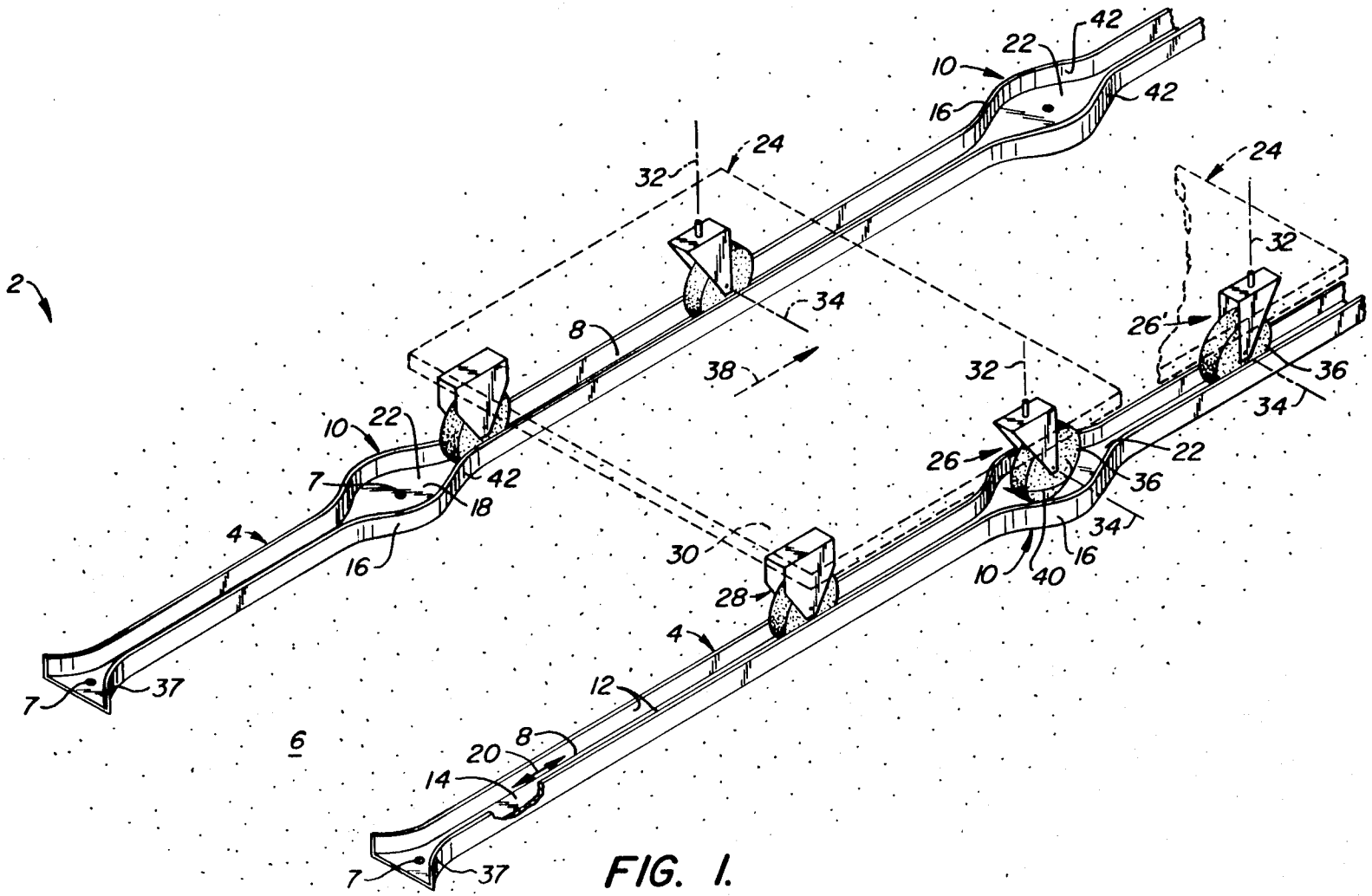
FIG. 1 is an isometric view of the cart track assembly of the present invention showing the wheels of a cart within the track segments.

Turning now to the figures, cart track assembly 2 includes a pair of tracks 4 typically mounted to a flat support surface 6 by screws 7. Although tracks 4 are usually mounted to the floor of the work area, they can also be mounted to trestle-like structures as well.

Tracks 4 include elongate main track segments 8 and widened transition track segments 10 between the main track segments. Main track segment 8 has a generally U cross-sectional shape with a pair of sides 12 and a bottom 14. Widened track segment 10 includes a pair of outwardly bowed sides 16 connected by a widened bottom 18. Main track segment 8 defines a relatively narrow pathway 20 while widened segment 10 defines a relatively wide transition area 22.

Figure 2A:
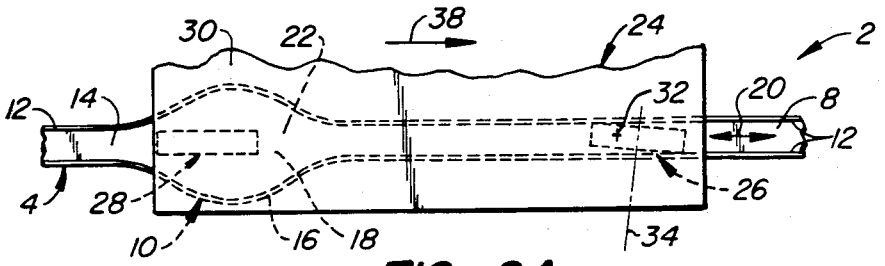
FIGS. 2A and 2B are partial top and side views of the cart track assembly of the invention showing a steerable castor wheel dragging along the sides of a main track segment.
Figure 2B:
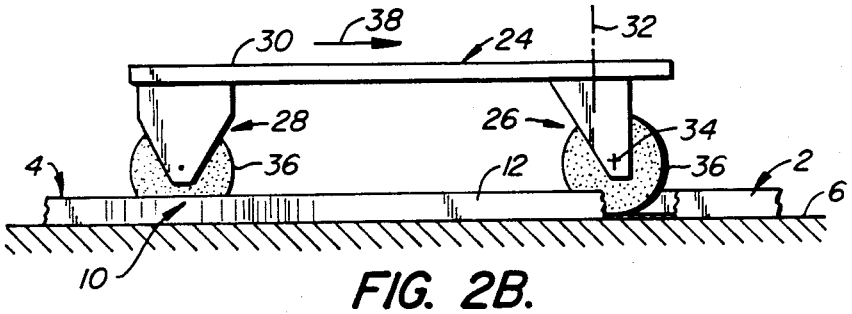

Assembly 2 is used to guide movement of a cart 24. Cart 24 has a pair of steerable front castor wheels 26 and a pair of non-steerable rear wheels 28. Castor wheels 26 are mounted to the main frame 30 of cart 24 in a manner to allow wheels 26 to pivot about a vertical pivot axis 32. Axis 32 is offset from the horizontal rotational axis 34 of wheels 36 as shown in FIGS. 2A and 2B.

Figure 3A:
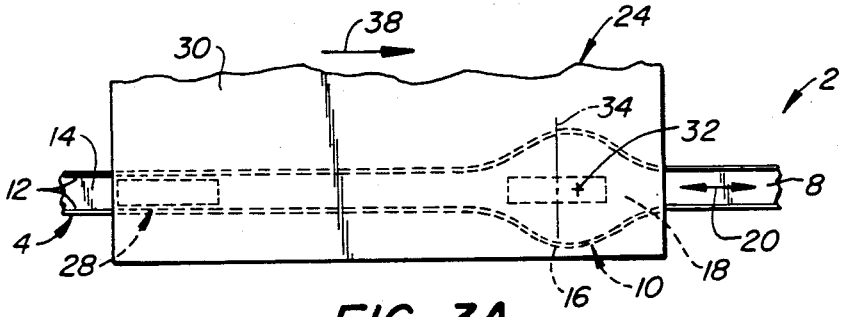
FIGS. 3A and 3B are partial top and side views of the cart and cart track assembly of FIGS. 2A and 2B showing the steerable castor wheel after turning around within a widened track segment.
Figure 3B:
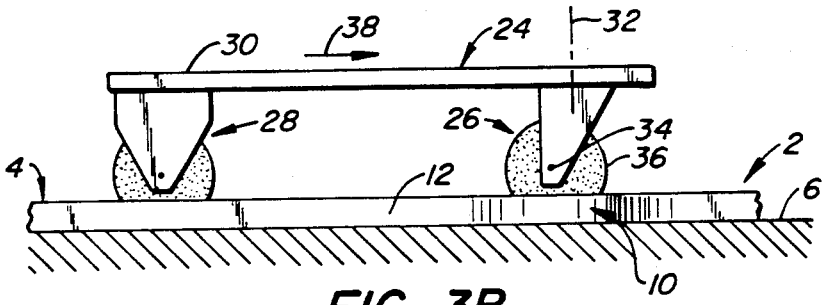

Tracks 4 are separated at an appropriate distance to allow front castor wheels 26 and rear wheels 28 to move within and be guided by the tracks. Entry into tracks 4 is aided by the provision of flared open ends 37. So long as rotational axis 34 trails pivot axis 32 with respect to the direction of travel, indicated by arrow 38 and illustrated in FIGS. 3A and 3B, castor wheels 26 will progress smoothly along pathway 20. However, once the direction of travel of cart 24 is reversed, castor wheels 26 try to pivot about pivot axis 32 but are kept from doing so by sides 12. This, illustrated in FIGS. 2A and 2B, causes wheels 36 of castor wheels 26 to drag along sides 12.

Widened segments 10 eliminate this problem by providing widened transition area 22 within which castor wheels 26 can pivot 180° until rotational axis 34 once again trails pivot axis 32. This sequence of events is illustrated by FIGS. 2A, 2B, 3A and 3B. It is also illustrated in FIG. 1 where castor wheel 26 is shown within the transition area 22 before it has pivoted in the direction of arrow 40. Castor wheel 26' is shown as it would appear after moving in the direction of arrow 38 with rotational axis 34 trailing pivot axis 36. The smoothly curving, flared portions 42 of sides 16 help guide the castor wheels as they enter main track segments 8 from widened segments 10.

Modification and variation can be made to the disclosed embodiment without departing from the subject of the invention as defined in the following claims. For example, part or all of sides 16 may be omitted from widened track segment 10. This is possible when widened segments 10 are properly staggered to ensure cart 24 continues to move parallel to tracks 4 while a castor wheel 26 pivots within area 22. Also, main track segment 8 and widened segments 10 may be made from sides mounted directly to support surface 6, thus omitting bottoms 14, 18.

I claim:

1. A track assembly, for use with carts having castor wheels pivotable about generally vertical axes, for guiding the carts over a surface comprising:

first and second parallel tracks mounted to the surface;

said first and second tracks each including first and second main segments and first and second transition segments connecting said main segments;

said first and second transition segments sized to permit the castor wheels to pivot 180° about the generally vertical axes to avoid movement of the castor wheels backward along the track, said first and second transition segments positioned so that not more than one of the cart wheels are in any of said transition segments at the same time; and said main segments including upright parallel sides spaced apart by a first distance for guiding the castor wheels therebetween for movement over the surface.

2. The track assembly of claim 1 wherein said first and second transition segments are positioned so at most one of the cart wheels are in any of said transition areas at the same time.

3. The track assembly of claim 2 wherein the transition segments have sidewalls.

* * * * *